US006705183B1

(12) United States Patent
Dickens

(10) Patent No.: US 6,705,183 B1
(45) Date of Patent: Mar. 16, 2004

(54) MULTIPURPOSE TOOL

(75) Inventor: James E. Dickens, Ocoee, FL (US)

(73) Assignee: Bellsouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/282,780

(22) Filed: Oct. 29, 2002

(51) Int. Cl.[7] ..... B25F 1/00

(52) U.S. Cl. ..... 81/437; 81/439; 7/138; 7/165

(58) Field of Search ..... 81/437, 439, 960, 81/177.85, 125.1, 124.5, 177.2; 7/165, 138, 108, 167

(56) References Cited

U.S. PATENT DOCUMENTS

| | | | | | |
|---|---|---|---|---|---|
| 285,304 | A | * | 9/1883 | Pearson | 7/138 |
| 887,644 | A | | 5/1908 | Jacobs | |
| 1,259,603 | A | * | 3/1918 | Conord | 81/490 |
| 1,281,438 | A | | 10/1918 | Tuttle | |
| 1,323,056 | A | | 11/1919 | Hofmann | |
| 1,325,070 | A | * | 12/1919 | Andrews | 81/439 |
| 1,689,376 | A | | 10/1928 | Zilliox | |
| 1,696,019 | A | * | 12/1928 | Sievern | 81/125.1 |
| 2,453,901 | A | | 11/1948 | Gonsett | |
| 3,177,910 | A | | 4/1965 | Silva | |
| 3,370,307 | A | * | 2/1968 | Beeks | 7/138 |
| 3,826,160 | A | * | 7/1974 | Allen et al. | 81/418 |
| 4,551,875 | A | * | 11/1985 | Getz et al. | 7/138 |
| 4,578,835 | A | | 4/1986 | Pichler et al. | |
| 4,733,584 | A | * | 3/1988 | Karge | 81/177.85 |
| 4,774,736 | A | | 10/1988 | Brawner et al. | |
| 5,086,674 | A | | 2/1992 | Her | |
| 5,313,860 | A | * | 5/1994 | Liou | 81/437 |
| 5,497,522 | A | * | 3/1996 | Chen | 7/128 |
| 5,778,896 | A | * | 7/1998 | Seals et al. | 131/181 |
| 6,286,400 | B1 | | 9/2001 | Anderson et al. | |
| 6,305,255 | B1 | | 10/2001 | Wu | |
| 6,418,821 | B1 | | 7/2002 | Yamakawa | |

* cited by examiner

*Primary Examiner*—Joseph J. Hail, III
*Assistant Examiner*—Hadi Shakeri
(74) *Attorney, Agent, or Firm*—Walters & Zimmerman

(57) ABSTRACT

A 4-in-1 tool is disclosed. The tool has an elongate handle having a first end, a second end, and a longitudinal bore. A first socket longitudinally extends from the first end, while a second socket longitudinally extends from the second end. The first socket has a different size than the second socket. An elongated shank is disposed in the longitudinal bore of the handle, and the shank moves within the longitudinal bore. The shank has a screwdriver bit at one end and a security wrench at an opposite end. The security wrench is for engaging a fastener at a demarcation point of a telecommunications network. The elongated shank has at least a first position and a second position. The first position outwardly extends the screwdriver bit beyond the first socket, and the second position outwardly extends the security wrench beyond the second socket.

7 Claims, 8 Drawing Sheets

MULTIPURPOSE TOOL

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but the copyright owner otherwise reserves all copyrights whatsoever.

BACKGROUND OF THE INVENTION

1. Field of the Invention

This invention generally relates to hand tools and, more particularly, to combined wrenches and screwdrivers.

2. Description of the Related Art

The 216-Type tool is very common in the telecommunications industry. The 216-Type tool is commonly called a "can wrench" and is a dual-purpose wrench. The tool is used to access communications terminals, and the tool has a thin-walled socket wrench on each end. The 216-Type tool typically has a 7/16-inch socket at one end and a 3/8-inch socket at an opposite end. Some terminal enclosures require the thin-walled 7/16 socket wrench, while other terminal enclosures require the thin-walled 3/8 socket wrench. This single tool, then, conveniently functions as two essential tools for accessing and for servicing communications terminals.

Even though the 216-Type can wrench is convenient, more tools are often required when accessing and servicing communications terminals. Many communications terminals, for example, require a screwdriver and/or a nut driver during access and service. There is, accordingly, a need for an improved tool that allows access to communications terminals, and a need for improved multipurpose tool that can be used during service of communications terminals.

BRIEF SUMMARY OF THE INVENTION

The aforementioned problems, and other problems, are reduced by a multipurpose tool. This invention is multiple, separate tools that are packaged as a single hand tool. This tool is especially designed for single-handed operation. One embodiment of this tool has an elongate handle with a socket at each end. A screwdriver may be extended from within each socket. A Phillips-head screwdriver, for example, may be extended and protrude beyond one socket, while a flat-head screwdriver may be extended from within the other socket. Because the sockets are preferably of different sizes, the sockets and the screwdrivers allow the handle to be used as four (4) different tools.

One embodiment of this invention describes a hand tool. An elongate handle defines a longitudinal axis, and the elongate handle has a first end and a second end. The handle also has a longitudinal bore extending from the first end to the second end. A first socket longitudinally extends from the first end of the handle, and the first socket has a polygonally-shaped interior cross-section. A second socket longitudinally extends from the second end of the handle, and the second socket also has a polygonally-shaped interior cross-section. The interior cross-section of the first socket is of a different size than the interior cross-section of the second socket. An elongate shank is disposed in the longitudinal bore of the handle, and the shank moves within the longitudinal bore. The shank has a screwdriver bit at one end and a security wrench at an opposite end. The security wrench is used for engaging a fastener at a demarcation point of a telecommunications network. The elongated shank has at least a first position and a second position. The first position outwardly extends the screwdriver bit beyond the first socket, and the second position outwardly extends the security wrench beyond the second socket.

Another embodiment of this invention also describes a 4-in-1 hand tool. This embodiment also has an elongate handle defining a longitudinal axis. The elongate handle has a first square drive at a first end and a second square drive at a second end. The first square drive and the second square drive are for attaching conventional sockets, extensions, and other tools. The elongate handle also has a longitudinal bore extending from the first end to the second end. An elongate shank is disposed in the longitudinal bore of the handle, and the shank moves within the longitudinal bore. The shank has a screwdriver bit at one end, and the shank has at least a first position and a second position. The first position extends the screwdriver bit and the second position retracts the screwdriver bit.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

Figure 1:
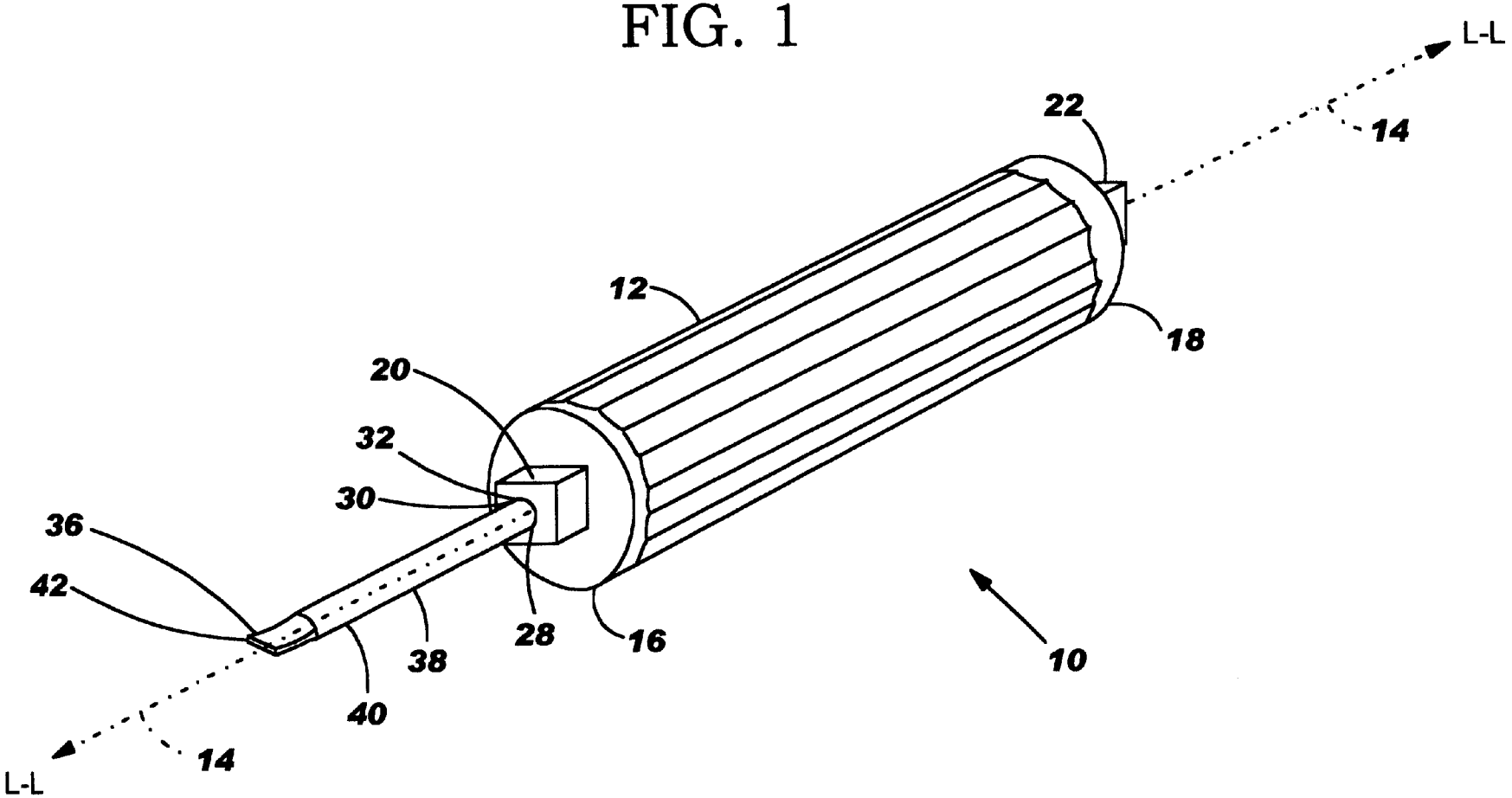
FIGS. 1–7 are schematics illustrating one embodiment of a multipurpose tool according to this invention.
Figure 2:
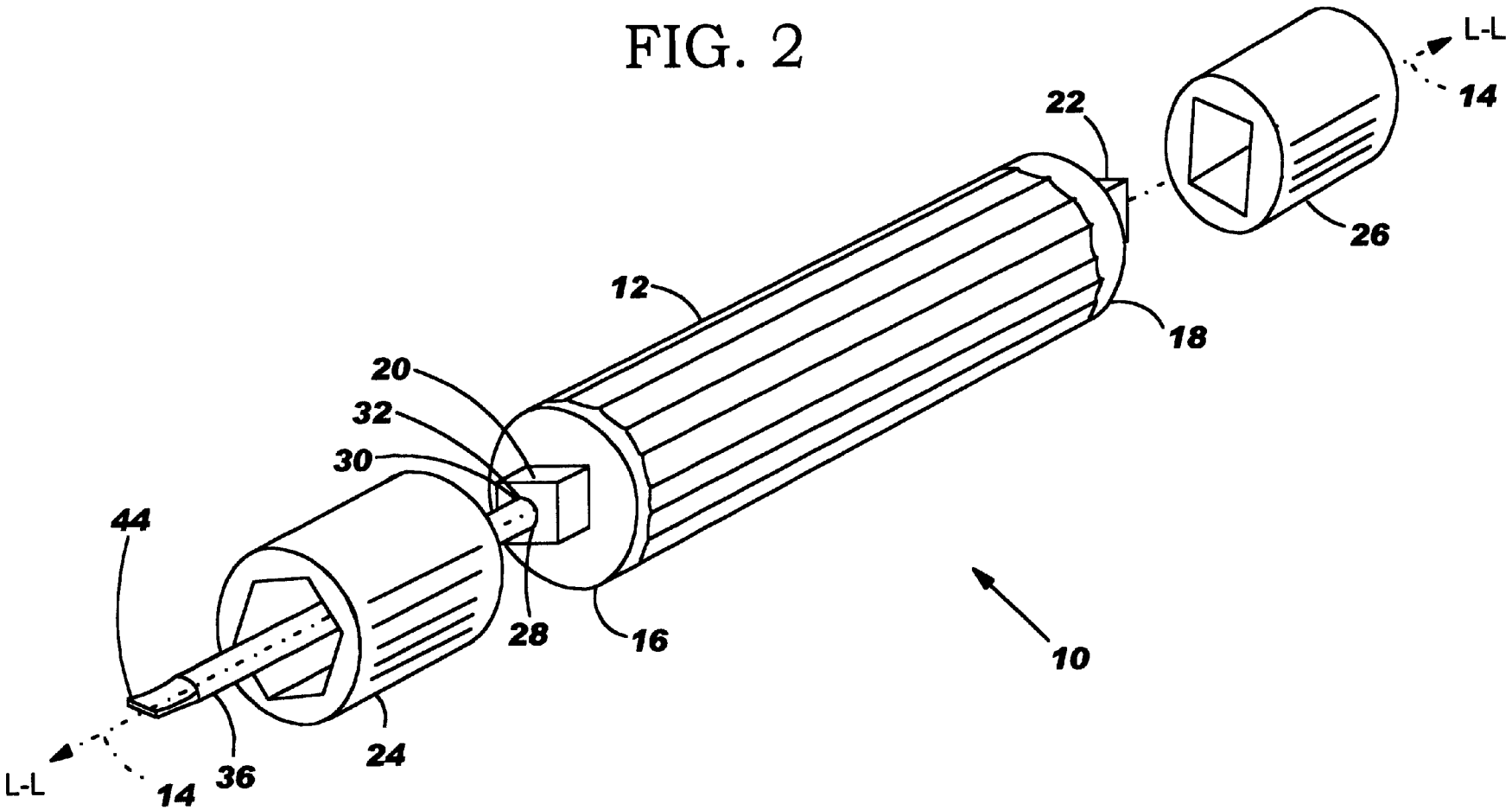

FIGS. 1–7 show one embodiment of this invention. FIGS. 1 and 2 are schematics illustrating a multipurpose tool. This tool 10 has an elongate handle 12. The handle 12 defines a longitudinal axis L-L (shown as reference numeral 14). The elongate handle 12 has a first end 16 and an opposite, second end 18. The first end 16 includes a first square drive 20, while the second end 18 includes a second square drive 22. The first square drive 20 and the second square drive 22 permit the attachment of conventional sockets, extensions, and other tools. As FIG. 2 shows, a first socket 24 and a second socket 26 are examples of various tools that may be attached to the square drives 20 and 22 of the handle 12.

The elongate handle 12 also has a longitudinal bore 28. The longitudinal bore 28 extends from the first end 16 to and through the second end 18. As FIG. 1 shows, the longitudinal bore 28 is bounded by an inner wall 30. The longitudinal bore 28 extends through the handle 12 to an opening 32 in the first square drive 20. The longitudinal bore 28, likewise, extends through the handle 12 to an opening (shown as reference numeral 34 in FIG. 5) in the second square drive 22. While the longitudinal bore 28 is preferably concentric to the handle 12 and to the longitudinal axis L-L, the longitudinal bore 28 could have an alternate orientation to the longitudinal axis L-L.

The tool 10 also includes a screwdriver 36. An elongate screwdriver shank 38 is disposed within the longitudinal bore 28 of the handle 12. The shank 38 moves or slides along and within the longitudinal bore 28. One end 40 of the shank 38 has a screwdriver bit 42. As FIG. 2 shows, the screwdriver bit 42 may be a flat head blade 44, while FIG. 3 shows the screwdriver bit 42 may be a Phillips-head 46.

Figure 3:
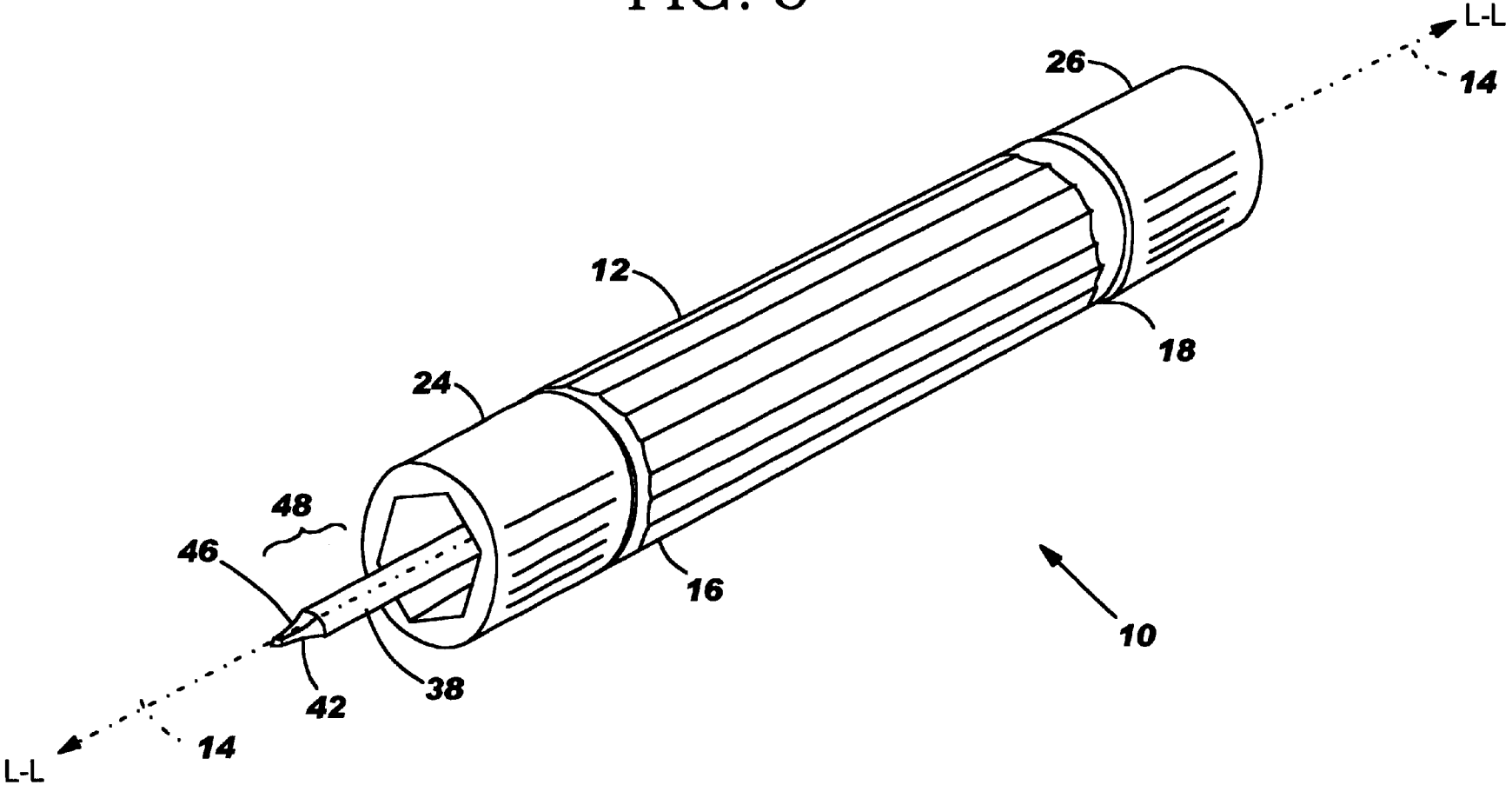
Figure 4:
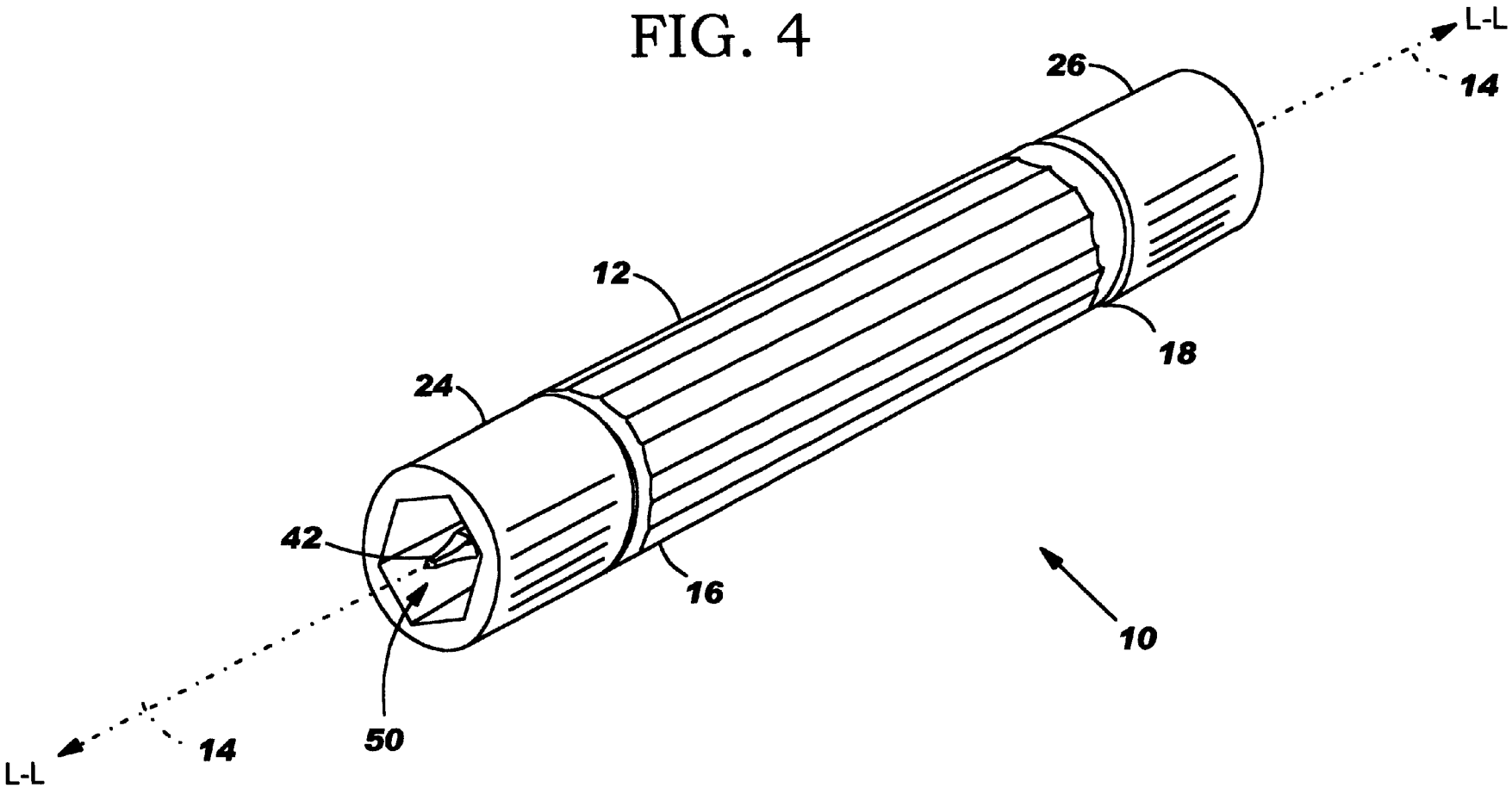

As FIGS. 3 and 4 also show, the shank 38 has at least two (2) positions. FIG. 3 shows a first position 48 that extends the shank 38. When the shank 38 is extended, the screwdriver bit 42 outwardly extends beyond the first socket 24. FIG. 4 shows a second position 50 that retracts the screwdriver bit 42. When the shank 38 is retracted, the screwdriver bit 42 retracts inside the first socket 24.

Figure 5:
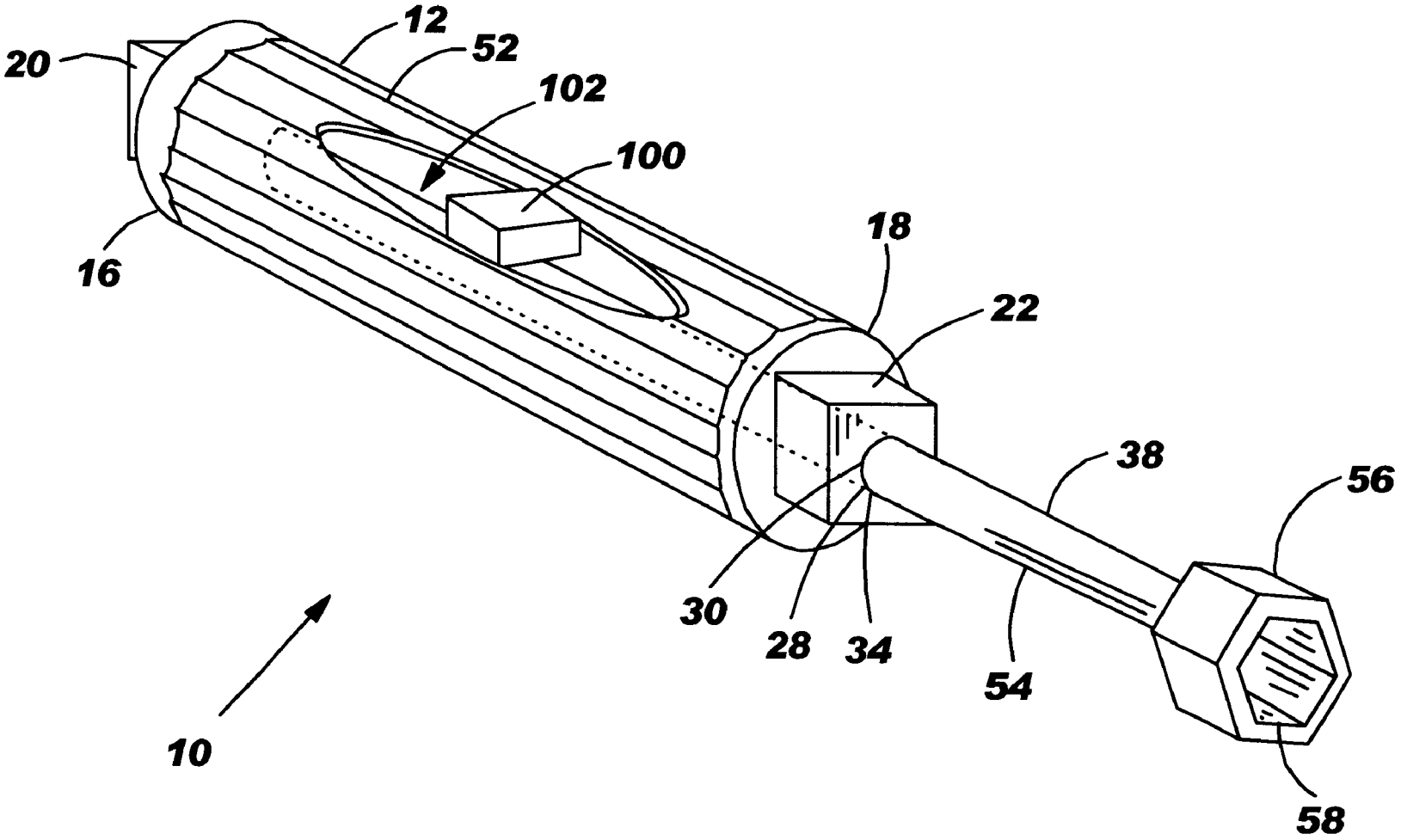
Figure 6:
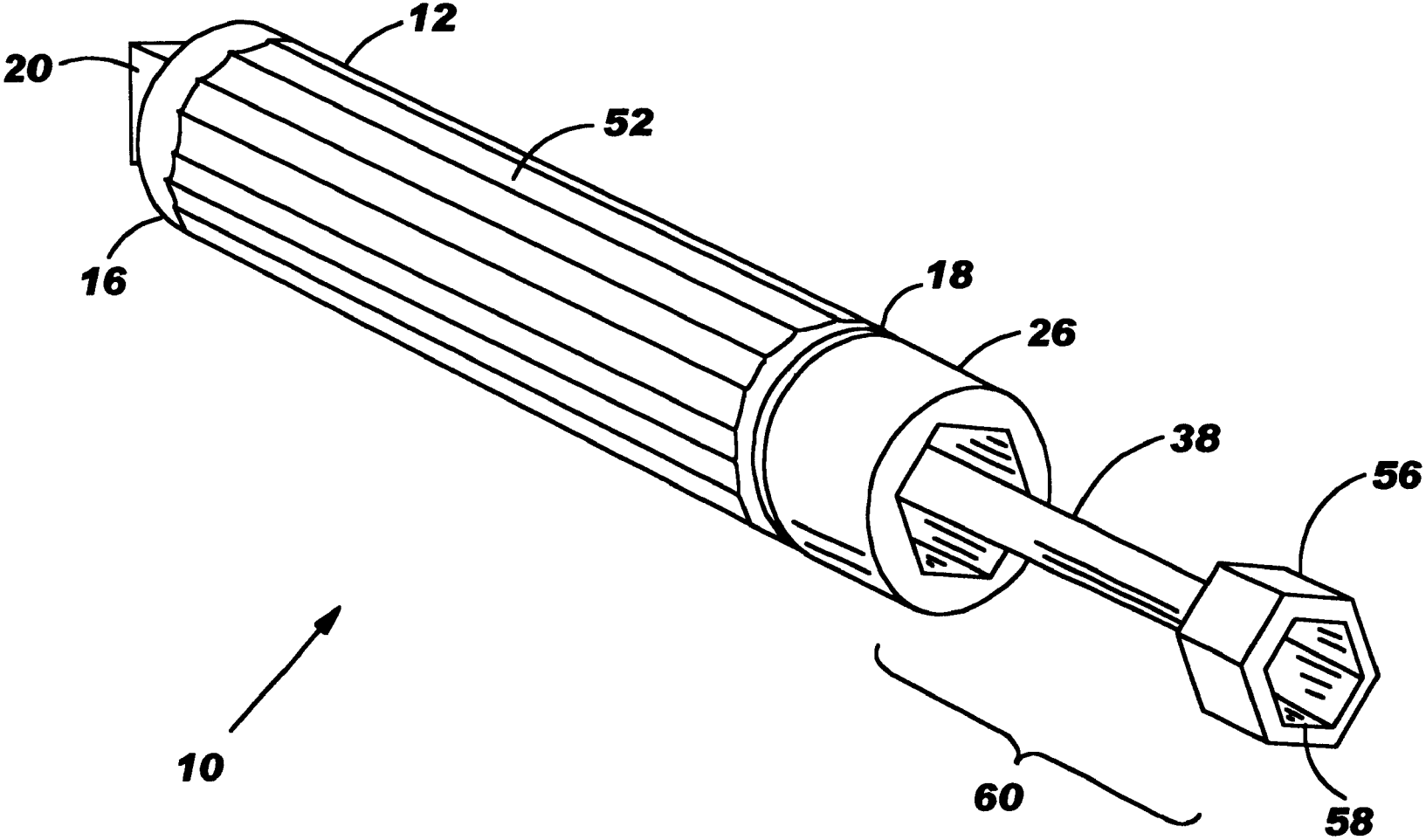

FIGS. 5 and 6 show additional details of the tool 10. FIGS. 5 and 6 are views of the second end 18 of the tool 10. Because the tool 10 may be used to drive sockets and screws, the handle 12 may include a contoured gripping surface 52. The contoured gripping surface 52 allows a user to apply more torque for tightening and for loosening. The contoured gripping surface 52 preferably includes a nonconductive material to reduce electrical shock. FIG. 5 also shows the longitudinal bore 28 extending from the first end 16 to and through the second end 18.

The longitudinal bore 28, bounded by the inner wall 30, extends through the handle 12 to the opening 34 in the second square drive 22. The elongate shank 38 is disposed within the longitudinal bore 28, and the shank 38 slides along and within the longitudinal bore 28. Whereas one end (shown as reference numeral 40 in FIGS. 1–4) of the shank 38 has the screwdriver bit, an opposite end 54 of the shank 38 includes a security wrench 56.

As those of ordinary skill in the art recognize, the security wrench 56 is used to open and close a Network Interface Device (not shown) of a telecommunications network. The Network Interface Device typically represents a demarcation point within the telecommunications network. The Network Interface Device separates the telecommunications service provider's responsibilities from the customer's inside wiring. The security wrench 56 engages a specialty fastener in the Network Interface Device. This specialty fastener helps prevent the customer from tampering with wires and connections that are the responsibility of the service provider. The specialty fastener resembles an ordinary Allen hex-head screw, but this specialty fastener has a center post in the hex-head. An Allen head key/wrench, therefore, cannot be inserted into the head of the specialty fastener. The security wrench 56, then, is a thin-walled socket with a hexagonally-shaped exterior 58. The security wrench 56 engages the specialty fastener in the Network Interface Device. The security wrench 56 could have a smoothly bored interior cross section to accept the center post in the head of the specialty fastener. The security wrench 56 may also have a polygonally-shaped interior cross section to accept the center post in the head of the specialty fastener.

The security wrench 56 could also function as a driver. If, for example, the security wrench 56 has a polygonally-shaped interior cross section (such as a hexagonally-shaped interior cross section), the interior cross section could accept screwdriver bits, Torx® bits, and other tools. The elongate shank 38 could also include a square drive at the opposite end 40. The square drive allows the attachment of conventional sockets, extensions, and other tools. The elongate shank 38 could also be made of a magnetic material to help retain the screwdriver bits, Torx® bits, conventional sockets, extensions, and other tools.

Figure 7:
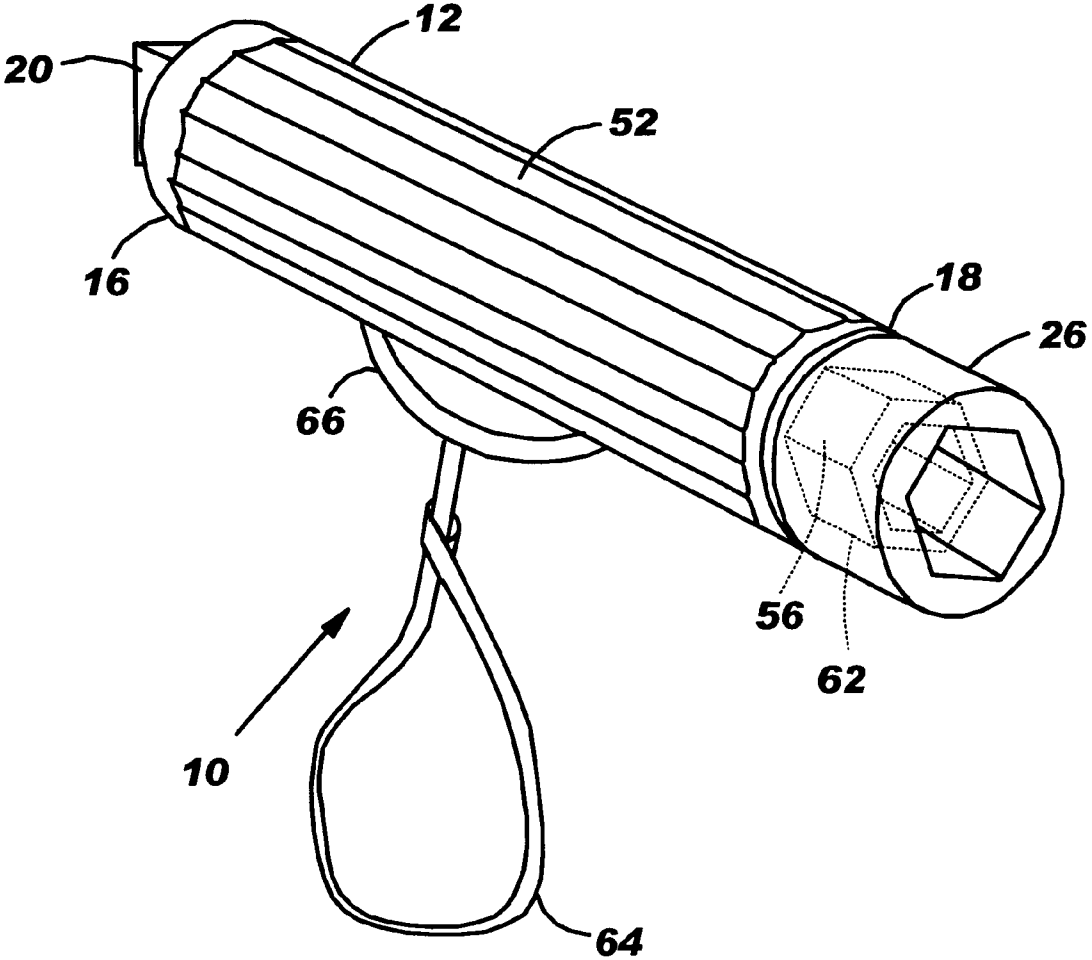

FIGS. 6 and 7 show the at least two (2) positions of the shank 38. FIG. 6 shows a first position 60 extends the shank 38, causing the security wrench 56 to outwardly extend beyond the second socket 26. FIG. 7 shows a second position 62 that retracts the security wrench 56 inside the second socket 26. FIG. 7 also shows a wrist strap 64. The wrist strap 64 attaches to the tool 10 and helps a person retrieve the tool 10 when dropped. The wrist strap 64 is especially useful when the person is using the tool 10 at elevated heights (such as rooftops or telephone poles). The wrist strap 64 is shown wrapped around a loop 66 extending from the handle 12.

Figure 9:
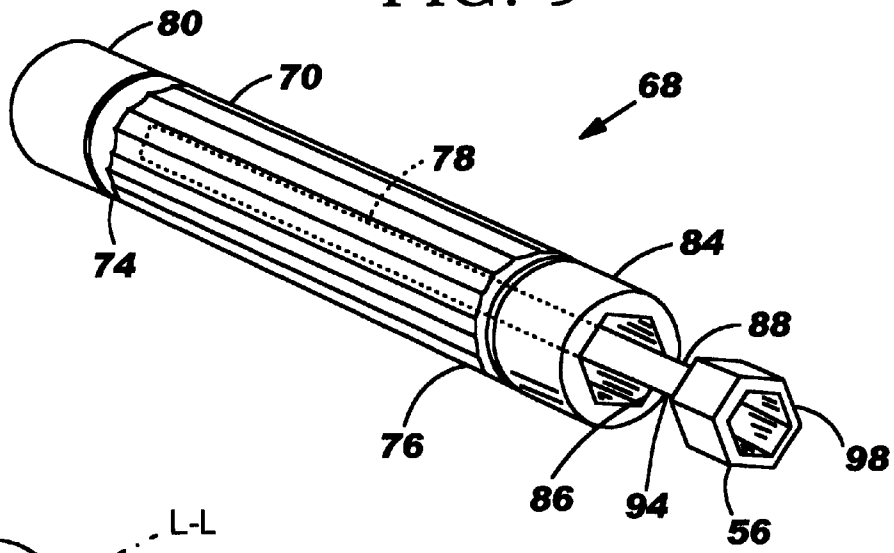
FIGS. 8 and 9 are schematics illustrating another embodiment of a multipurpose tool according to this invention.
Figure 8:
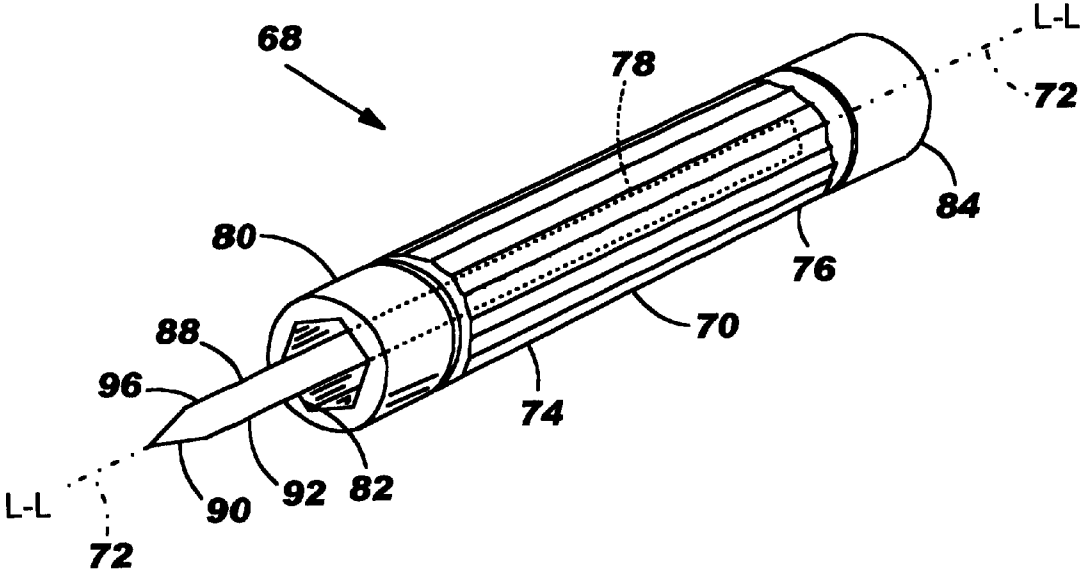

FIGS. 8 and 9 show another embodiment of this invention. This embodiment is also a multipurpose tool 68. An elongate handle 70 defines a longitudinal axis L-L (shown as reference numeral 72). The elongate handle 70 has a first end 74, a second end 76, and a longitudinal bore 78 extending from the first end 74 to the second end 76. A first socket 80 longitudinally extends from the first end 74 of the handle 70. The first socket 80 has a polygonally-shaped interior cross-section 82. A second socket 84 longitudinally extends from the second end 76 of the handle 70, and the second socket 84 also has a polygonally-shaped interior cross-section 86. The interior cross-section 82 of the first socket 80 has a different size than the interior cross-section 86 of the second socket 84. An elongated shank 88 is disposed in the longitudinal bore 78, and the shank 88 moves or slides within the longitudinal bore 78. The shank 88 has a screwdriver bit 90 at one end 92 and the security wrench 56 at an opposite end 94. FIG. 8 shows a first position 96 of the shank 88 that outwardly extends the screwdriver bit 90 beyond the first socket 80. FIG. 9 shows a second position 98 that outwardly extends the security wrench 56 beyond the second socket 84.

The first socket 80 and the second socket 84 are preferably hex-head sockets with reduced outside diameters. The first socket 80 and the second socket 84 are preferably 216-Type "can wrenches" that permit access to Network Interface Devices in a telecommunications network. These can wrenches are ⅜-inch and 7/16-inch sizes and have reduced outside diameters. Although the multipurpose tool 68 is heretofore unavailable, can wrenches are commercially available (see, e.g., tool No. F003200 and tool No. F003205 available from Marconi plc, 1000 Marconi Drive, Warrendale, Pa. 15086-7502, 1-866-627-2664, www.marconi.com, and tool No. 19195 available from Stanley-Proto Industrial Tools, 14117 Industrial Park Blvd. NE, Covington, Ga. 30014 USA, 770-787-3800, www.stanleyproto.com).

The multipurpose tool 68 may also include other features. The screwdriver bit 90 may be a flat head screwdriver bit (such as the flat head blade 44 shown in FIG. 2) or a Phillips-head bit (such as the Phillips-head bit 46 shown in FIG. 3). The handle 70 may include an insulating, contoured gripping surface (such as the contoured gripping surface 52 shown in FIGS. 5 and 6). The tool 68 may also include a wrist strap to help retrieve the tool when dropped (such as the wrist strap 64 shown in FIG. 7).

The embodiments of this invention would also include inner componentry. Because these embodiments are preferably utilized with a single hand, the embodiments would include means for extending and retracting the elongate shank 38, 88. As FIG. 5 shows, a thumb slide 100, for example, would allow a person to single-handedly hold the tool 10, 68 and, yet, extend and retract the elongate shank 38, 88. The thumb slide 100, would connect to the shank 38, 68 and slide along a slot 102 in an outer surface of the handle 12, 70. The means for extending and retracting the elongate shank 38, 88 may also include one or more springs to bias the elongate shank 38, 68 to a retracted or an extended position.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. A tool, comprising:

an elongate handle defining a longitudinal axis, the elongate handle having a first male square drive at a first end and a second male square drive at a second end, the first male square drive and the second male square drive for attaching a conventional female-ended tool, the elongate handle also having a longitudinal bore extending from an opening in the first square drive at the first end to an opening in the second square drive at the second end; and an elongate shank disposed in the longitudinal bore of the handle, the shank moving within the longitudinal bore, the shank having a screwdriver bit at one end, wherein the elongated shank has at least a first position and a second position, the first position extending the screwdriver bit, through one of said openings and the second position retracting the screwdriver bit.

2. A tool according to claim 1, wherein the elongated shank comprises a security wrench at an end opposite to the screwdriver bit, the security wrench for engaging a fastener, the security wrench having at least one of i) a hexagonally-shaped exterior surface for accessing the fastener, ii) a smoothly bored interior cross section for accessing the fastener, and iii) a polygonally-shaped interior cross section for accessing the fastener.

3. A tool according to claim 1, wherein the screwdriver bit of the elongated shank is a flat head screwdriver bit.

4. A tool according to claim 1, wherein the screwdriver bit of the elongated shank is a Phillips head screwdriver bit.

5. A tool according to claim 1, wherein the handle further comprises a contoured gripping surface.

6. A tool according to claim 5, wherein the contoured gripping surface comprises an insulative material.

7. A tool according to claim 1, further comprising a wrist strap to help retrieve the tool when dropped.

* * * * *